US011808230B2

(12) United States Patent
Moine

(10) Patent No.: US 11,808,230 B2
(45) Date of Patent: Nov. 7, 2023

(54) METHOD FOR ESTIMATING THE PRESSURE IN AN INTAKE MANIFOLD

(71) Applicant: Vitesco Technologies GmbH, Regensburg (DE)

(72) Inventor: Xavier Moine, Toulouse (FR)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 18/020,170

(22) PCT Filed: Sep. 14, 2021

(86) PCT No.: PCT/EP2021/075238
§ 371 (c)(1),
(2) Date: Feb. 7, 2023

(87) PCT Pub. No.: WO2022/073729
PCT Pub. Date: Apr. 14, 2022

(65) Prior Publication Data

US 2023/0212998 A1 Jul. 6, 2023

(30) Foreign Application Priority Data

Oct. 9, 2020 (FR) ..... 2010331

(51) Int. Cl.
*F02D 41/34* (2006.01)

(52) U.S. Cl.
CPC ..... *F02D 41/34* (2013.01); *F02D 2200/0402* (2013.01); *F02D 2200/0408* (2013.01)

(58) Field of Classification Search
CPC ..... F02D 2250/14; F02D 41/6002
See application file for complete search history.

(56) References Cited

U.S. PATENT DOCUMENTS 3,722,487 A 3/1973 Ohama et al.
3,736,912 A 6/1973 Okura et al.
(Continued)

FOREIGN PATENT DOCUMENTS

CA 945854 A 4/1974
JP 06185396 A 7/1994
(Continued)

OTHER PUBLICATIONS

International Search Report and Written Opinion for International Application No. PCT/EP2021/075238, dated Jan. 12, 2022, 9 pages.
(Continued)

*Primary Examiner* — John Kwon
(74) *Attorney, Agent, or Firm* — RatnerPrestia

(57) ABSTRACT

A method for estimating pressure in an intake manifold of an indirect injection combustion engine. A pressure sensor measures pressure in the intake manifold, the intake manifold being in fluidic communication with a combustion cylinder, a piston guided in translation in the combustion cylinder and connected to a rotating crankshaft. The method includes: measuring, with the pressure sensor, a maximum pressure corresponding substantially to a maximum pressure in the intake manifold during a preceding cycle of the engine; measuring, with the pressure sensor, a minimum pressure corresponding substantially to a minimum pressure in the intake manifold during the preceding cycle of the engine; determining a pre-calculated average pressure correction factor from a crankshaft angular position and from an engine speed; and estimating the pressure in the intake manifold for the crankshaft angular position of the current engine cycle from the average correction factor and from the minimum and maximum pressures.

10 Claims, 4 Drawing Sheets

(56) References Cited

U.S. PATENT DOCUMENTS

| | | | | |
|---|---|---|---|---|
| 4,696,275 | A | 9/1987 | Kushi et al. | |
| 5,003,950 | A | 4/1991 | Kato et al. | |
| 5,448,977 | A | 9/1995 | Smith et al. | |
| 6,405,122 | B1 * | 6/2002 | Yamaguchi | G06N 3/043 706/31 |
| 7,359,794 | B2 | 4/2008 | Hakariya et al. | |
| 2015/0240739 | A1 * | 8/2015 | Pursifull | F02D 41/221 123/445 |
| 2016/0377018 | A1 * | 12/2016 | Sanborn | F02M 63/029 123/457 |
| 2020/0256224 | A1 * | 8/2020 | Yoo | F01M 13/0011 |
| 2022/0018303 | A1 * | 1/2022 | Moine | F02D 41/0002 |

FOREIGN PATENT DOCUMENTS

| | | | |
|---|---|---|---|
| KR | 101806361 | B1 | 1/2018 |
| WO | 2006082943 | A1 | 8/2006 |

OTHER PUBLICATIONS

International Search Report and Written Opinion for International Application No. PCT/EP2021/075238, dated Jan. 12, 2022, 13 pages (French).

* cited by examiner

METHOD FOR ESTIMATING THE PRESSURE IN AN INTAKE MANIFOLD

CROSS REFERENCE TO RELATED APPLICATIONS

This application is the U.S. National Phase Application of PCT International Application No. PCT/EP2021/075238, filed Sep. 14, 2021, which claims priority to French Patent Application No. FR2010331, filed Oct. 9, 2020, the contents of such applications being incorporated by reference herein.

FIELD OF THE INVENTION

The present invention relates to a method for estimating the pressure in an intake manifold. In an internal combustion engine, the knowledge of this pressure may make it possible in particular to compensate for variations thereof in order to better control the quantity of fuel injected into said manifold. The invention applies more particularly to indirect injection engines that have a small intake manifold volume.

BACKGROUND OF THE INVENTION

Traditionally, an intake system of a combustion engine comprises a throttle body for regulating an air flow for supplying an intake manifold in fluidic communication with one or more combustion cylinders. A piston is guided in translation in each combustion cylinder.

In particular, in the case of combustion engines known as indirect injection combustion engines, the air-fuel mixture intended for combustion is brought about at the intake manifold.

In this regard, a fuel injector is provided, the injection tip of which is disposed in the intake manifold in order to inject the fuel directly at the intake manifold as explained above, the mixture then being drawn into a combustion chamber via the opening of one or more intake valves and via a downward movement of the piston in its cylinder.

The proportions of the air-fuel mixture are decisive for allowing optimal combustion in the combustion cylinder. In particular, in order to deliver a given quantity of fuel via an injector, it is necessary to know the instantaneous flow rate of said injector in order for it to be possible to adapt its injection time (corresponding to the time between the opening and closing of the injector). The instantaneous flow rate is dependent, inter alia, on the pressure difference that exists between the pressure of the fuel in the injector and the pressure downstream of the injector. The latter corresponds to the pressure at the tip of the injector and therefore corresponds to the pressure at the intake manifold. This pressure changes to a greater or lesser extent during an engine cycle in particular when the volume of the intake manifold is small.

Specifically, it will be understood that the greater the volume of the intake manifold, the less the negative pressure brought about by the opening of one or more intake valves associated with a combustion cylinder in fluidic communication with the intake manifold.

Combustion engines having small intake manifold volumes are fitted for example in lawnmowers, scooters, motorcycles, etc.

In this case, the pressure in the intake manifold is dependent on the atmospheric pressure, on the crankshaft angular position, on the engine speed and on the engine load.

It is advantageous to be able to estimate the pressure in the intake manifold from very few pressure acquisitions in said manifold. Specifically, this makes it possible to address the real-time priorities of the system, that is to say the limited time required to acquire and process the item of pressure data during the engine cycle. This also makes it possible to lengthen the service life of the sensor and to reduce the memory associated with storing the measurements from the sensor, thereby also reducing the material and in particular electronic costs that are brought about.

It is furthermore advantageous to be able to estimate this pressure at each injection time of the engine cycle in order for it to be possible to determine the instantaneous flow rate of an injector at the time at which it needs to injector and to thus deduce therefrom an injection time for said injector. This makes it possible to bring about good combustion in the cylinder and to reduce the emissions of pollutants. In the context of engines that are not mounted in motor vehicles, the injection time of an injector is generally corrected by a method chosen from the two following methods.

The first method consists in evaluating a pressure in the intake manifold for a current engine operating point on the basis of a table of pressure values in the intake manifold that are associated with reference operating points of the engine. However, the table of pressure values in the manifold comprises only a small number of reference operating points of the engine and, as a result, the evaluated pressure corresponding to the pressure at the reference operating point closest to the current operating point of the engine is not very precise. In that respect, the method proposes then artificially modifying the air flow calculated at the inlet of the intake manifold in order to inject more or less fuel depending on this air flow, in order to reduce the different in pressure that exists between the actual pressure in the intake manifold and the pressure evaluated on the basis of this closest operating point. This method is not satisfactory inasmuch as the use of values over a small number of operating points of the engine and the modification of the air flow calculated as compensation tools are not very precise at all, with the result that the pressure in the intake manifold is usually underestimated.

The second method consists in correcting the pressure in the intake manifold on the basis of the calculation of an average value of the pressure in the intake manifold. The latter is obtained from a plurality of acquisitions of pressure in the intake manifold during an engine cycle. However, this method is only relevant when the pressure in the manifold does not fluctuate much during a single engine cycle. It is therefore not relevant for engines that have small intake manifold volumes.

In particular, the use of the first method in a 90° V two-cylinder lawnmower engine results in an underestimate of the pressure in the intake manifold by 0 to 340 mbar, while the use of the second method results in an overestimate of the pressure in the intake manifold by 0 to 330 mbar. Therefore, neither of these methods is satisfactory for correctly estimating the pressure in the intake manifold.

Furthermore, neither of these two methods is suitable for taking account of the different pressure variations from one cylinder to the other during a single cycle, as is the case for example for a V cylinder engine, in particular a 90° V two-cylinder engine (or one with another angle other than 180°).

SUMMARY OF THE INVENTION

A first aspect of the present disclosure is a method for estimating a pressure in an intake manifold of a combustion engine.

A second aspect of the present disclosure consists in obtaining a precise estimate of the pressure in the intake manifold independently of the engine load, even if the pressure changes substantially in the manifold during an engine cycle.

A third aspect of the present disclosed consists in obtaining this estimate on the basis of a small number of acquisitions by the sensor during the engine cycle.

A fourth aspect of the present disclosure is to be provide a method that takes account of the differences in pressure variation from one cylinder to the other in an engine such as a 90° V two-cylinder engine.

A fifth aspect of the present disclosure consists in proposing a method for correcting a quantity of fuel injected into the intake manifold from an estimate of the pressure in the intake manifold that is obtained by implementing the method for estimating the pressure in the intake manifold.

In this regard, the present discloses proposes a method for estimating a pressure in an intake manifold of an indirect injection combustion engine, comprising a pressure sensor measuring the pressure in the intake manifold, the intake manifold being in fluidic communication with a combustion cylinder, a piston being guided in translation in the combustion cylinder and connected to a rotating crankshaft, said method being characterized in that it comprises the following steps:

- measuring, with the pressure sensor, a maximum pressure value corresponding substantially to a maximum pressure in the intake manifold during a preceding cycle of the engine,
- measuring, with the pressure sensor, a minimum pressure value corresponding substantially to a minimum pressure in the intake manifold during the preceding cycle of the engine,
- determining a pre-calculated average pressure correction factor from a crankshaft angular position and from an engine speed, and
- estimating the pressure in the intake manifold for the crankshaft angular position of the current engine cycle from the average correction factor and from the minimum and maximum pressure values.

According to one embodiment, the measurement of the maximum pressure value is carried out at a time directly preceding an intake phase of the combustion cylinder, and the measurement of the minimum pressure value is carried out at a time directly preceding a compression phase of the combustion cylinder.

According to one embodiment, the average correction factor is determined from a table of correction factors comprising a plurality of average correction factors that are each associated with an engine speed and a determined angular position, and the determination of the average correction factor comprises the selection, from this table, of the average correction factor that is associated with the engine speed and with the corresponding angular position or that comes closest to the current engine speed and the determined crankshaft angular position.

According to one embodiment, an average correction factor for a determined engine speed and for a determined angular position is equal to the average of the correction factors having the same determined engine speed and the same determined angular position, and a correction factor is obtained from the following formula:

$$F_c = \frac{(P_r - P_{maxt})}{(P_{mint} - P_{maxt})} \quad \text{[Math. 1]}$$

where $F_c$ corresponds to the correction factor, $P_r$ corresponds to the actual pressure measured on a test bench in an intake manifold for the determined angular position for a current engine cycle, $P_{maxt}$ corresponds to a maximum pressure value of the intake manifold on a test bench of the preceding engine cycle, and $P_{mint}$ corresponds to a minimum pressure value of the intake manifold on a test bench of the preceding engine cycle.

According to one embodiment, the estimation of the pressure in the intake manifold comprises the use of the following formula:

$$P_{col}=P_{max}=(P_{min}-P_{max})\times F_{ac} \quad \text{[Math. 2]}$$

where $P_{col}$ corresponds to the pressure in the intake manifold of the current cycle of the engine for the crankshaft angular position, $P_{max}$ corresponds to the maximum pressure value of the engine cycle preceding the current cycle and measured during the measuring step, $P_{min}$ corresponds to the minimum pressure value in the intake manifold of the engine cycle preceding the current cycle and measured during the measuring step, and $F_{ac}$ corresponds to the average correction factor for the crankshaft angular position determined during the determining step.

According to one embodiment, the intake manifold is in fluidic communication with a plurality of combustion cylinders,

- the step of measuring a pressure value is implemented for each combustion cylinder,
- the method comprises an additional step of calculating an average minimum pressure value, and
- the average minimum pressure value is used instead of the minimum pressure in the estimation of the pressure in the intake manifold.

The present disclosure proposes a method for correcting a quantity of fuel injected in an indirect injection engine comprising a pressure sensor measuring the pressure in an intake manifold, the intake manifold being in fluidic communication with a combustion cylinder, a piston being guided in translation in the combustion cylinder and connected to a rotating crankshaft, the engine also comprising an injector, the tip of which is disposed in the intake manifold, the method comprising the following steps:

- estimating a pressure at the middle of injection in the intake manifold by implementing a method for estimating the pressure as set out above for a crankshaft angular position at the middle of injection of the injector,
- determining an instantaneous flow rate of the injector at a time at the middle of injection from the pressure in the intake manifold and from the pressure of the fuel in the injector,
- modifying an injection time of the injector depending on its instantaneous flow rate at the time at the middle of injection.

The present disclosure proposes a computer program product comprising code instructions for implementing the steps of a method as are described in detail above.

The present disclosure proposes a computer suitable for controlling an indirect injection engine comprising a pressure sensor measuring the pressure in an intake manifold, the intake manifold being in fluidic communication with a combustion cylinder, a piston being guided in translation in the combustion cylinder and connected to a rotating crankshaft, the engine also comprising an injector, the tip of which is disposed in the intake manifold, this computer also being suitable for controlling the implementation of the steps of a method as are described above.

Lastly, the present disclosure proposes an indirect injection engine comprising a pressure sensor measuring the pressure in an intake manifold, the intake manifold being in fluidic communication with a combustion cylinder, a piston being guided in translation in the combustion cylinder and connected to a rotating crankshaft, the engine also comprising an injector, the tip of which is disposed in the intake manifold, and a computer suitable for controlling the implementation of the steps of a method as are described above.

The method presented according to an aspect of the invention therefore makes it possible to estimate the pressure in the intake manifold with very few acquisitions per engine cycle. In this case, only one acquisition of a minimum pressure value and only another acquisition of a maximum pressure value (corresponding generally to the ambient pressure) are required per engine cycle, thereby making it possible in particular to adapt to the actual time constraints of the system and in particular to the time required for acquiring and processing the pressure measurements during the engine cycle. This also makes it possible to increase the service life of the sensor.

Furthermore, the estimate of the pressure in the intake manifold is rendered independent of the engine load on account of the use of a table of average correction factors, which are simply associated with an engine speed and a crankshaft angular position.

The method is also rendered robust with respect to the significant variations in the pressure in the intake manifold, unlike the known methods based on average values, since it makes it possible to estimate the pressure in the intake manifold throughout the engine cycle and in particular over the entire angular range of the crankshaft. In this configuration, the method makes it possible to estimate the pressure in the intake manifold for different engine geometries and in particular for V cylinder engines in which there is a certain phase offset between the cylinders, bringing about different pressure variations in the intake manifold.

This estimate of pressure in the intake manifold may in particular be used at an injection time in order to calculate an instantaneous flow rate of the injection delivering the injection, thus ultimately making it possible to calculate a quantity of fuel injected through the estimation of an injection time and therefore to optimize the efficiency of the engine while limiting emissions of pollutants. This is the object of the method for estimating a correction of a quantity of fuel injected.

BRIEF DESCRIPTION OF THE DRAWINGS

Further features, details and advantages will become apparent on reading the following detailed description, and on studying the appended drawings, in which.

More specifically, the left-hand graph shows, for a given engine speed, a plurality of correction factor curves, each curve representing a different engine load. The right-hand graph, for its part, shows a curve of an average correction factor for the given engine speed in the left-hand graph and corresponds to the average of the correction factor curves of the left-hand graph.

Figure 5:
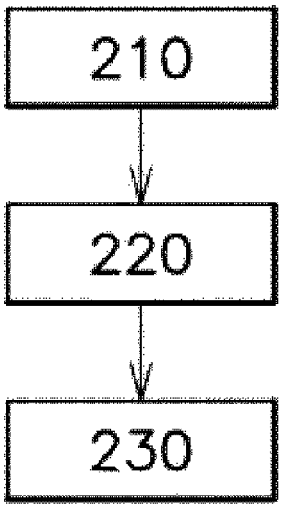

FIG. 5 shows a method for estimating a correction of a quantity of fuel injected into the intake manifold by an injector.

DETAILED DESCRIPTION OF THE PREFERRED EMBODIMENTS

Figure 1:
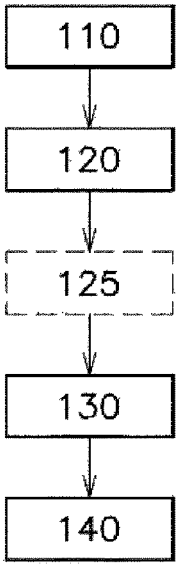
FIG. 1 shows an embodiment of the method for estimating a pressure in an intake manifold.
Figure 2:
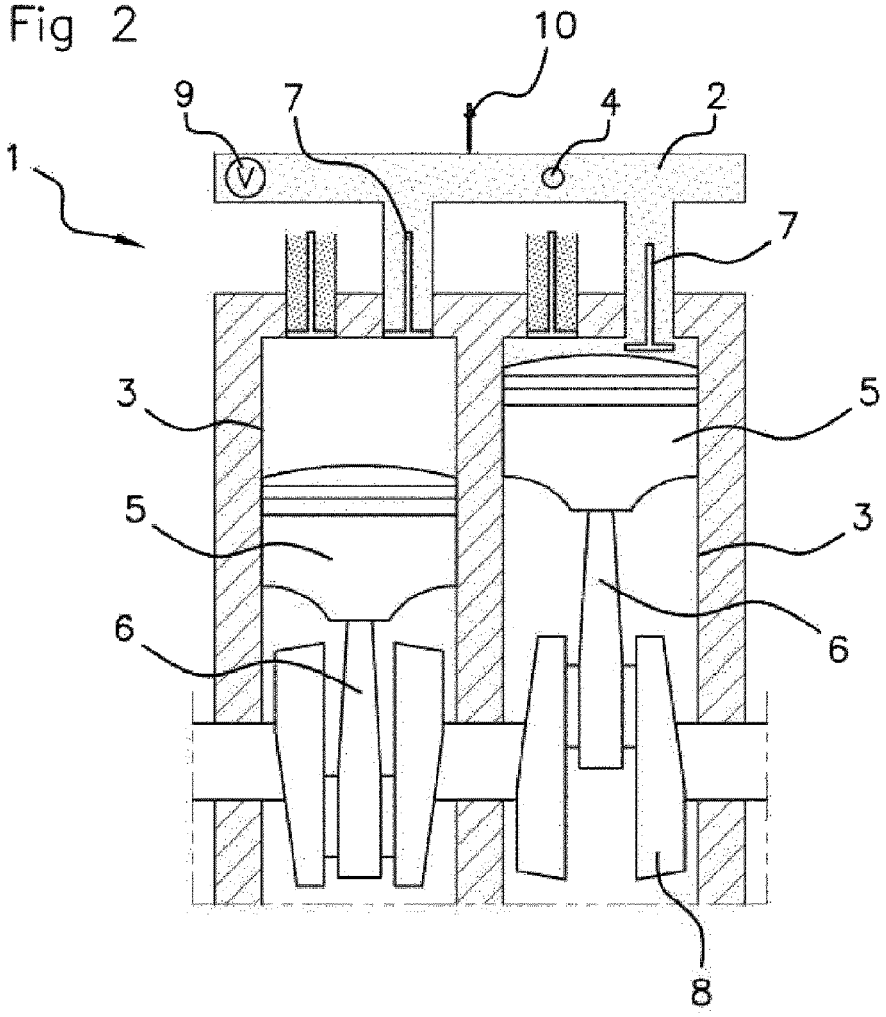
FIG. 2 shows an embodiment of a combustion engine in which the estimating method can be implemented.

Reference will now be made to FIG. 2, which shows, non-exhaustively, an indirect injection combustion engine 1 (referred to as engine 1 below) for implementing a method for estimating a pressure in an intake manifold described with reference to FIG. 1.

The engine 1 thus comprises an intake manifold 2 in fluidic communication with one or more combustion cylinders 3 via one or more intake valves 7 that is/are associated with each combustion cylinder 3. In this case, when the intake valve or valves 7 associated with a combustion cylinder 3 is/are open, there is effective fluidic communication between the intake manifold 2 and the combustion cylinder 3. A throttle body 9 is also shown and is used to regulate a feed air flow of the intake manifold 2 and, by extension, an air flow supplied to the combustion cylinder or cylinders 3 depending on the position of the respective valve or valves 7 thereof.

It will be considered, nonlimitingly, in the rest of the application and in order to make it easier to read that each combustion cylinder 3 is associated with one intake valve 7, although it may comprise several valves.

In the embodiment illustrated, the intake manifold 2 is in communication with two combustion cylinders 3. The method for estimating the pressure in the intake manifold is particularly suitable for implementation in a V two-cylinder engine, for example a 90° V two-cylinder engine.

In each combustion cylinder 3, a piston 5 is guided in translation and is connected to a crankshaft 8 by a connecting rod 6.

The engine 1 comprises an injector 10 having an injector tip that is allows it to inject fuel at the intake manifold 2. It also comprises a pressure sensor 4 suitable for measuring a pressure in the intake manifold 2. It may furthermore comprise a computer (not shown) for controlling the implementation of the method for estimating a pressure in an intake collector 2 presented in FIG. 1. The computer thus comprises a memory storing the code instructions for implementing the method. Advantageously, the computer for controlling the implementation of the method is an engine control unit. Of course, any other computer suitable for controlling this implementation may be envisioned.

Figure 3:
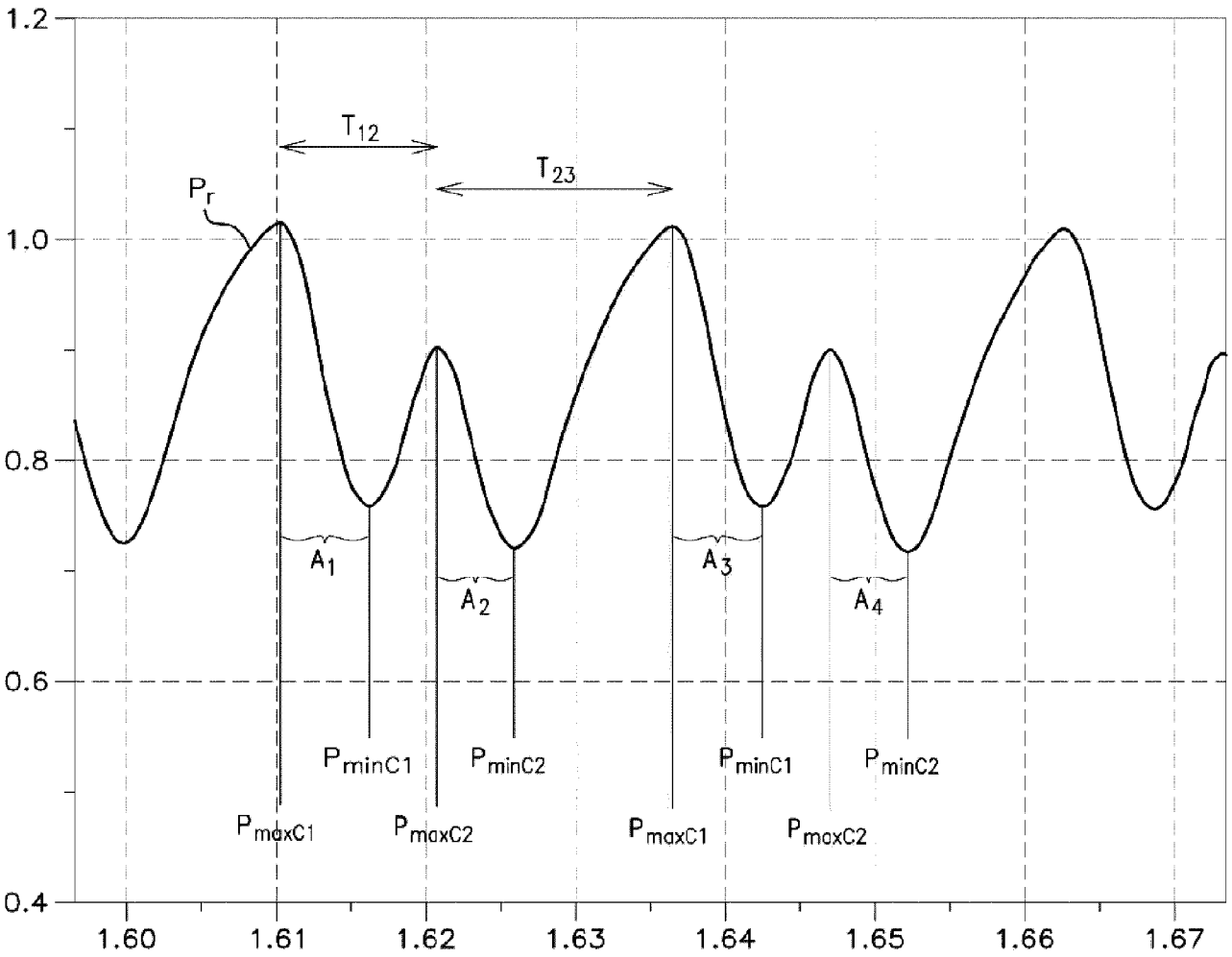
FIG. 3 shows a variation in pressure in an intake manifold of a 90° V two-cylinder engine.

In this case, the pressure in the intake manifold 2 depends on the quantity of air that the latter contains. For example, during an intake phase $A_1$ into a combustion cylinder 3, the transfer of the air from the intake manifold 2 to the combustion cylinder 3 brings about a negative pressure in the intake manifold 2. This negative pressure is shown in FIG. 3, in which the curve represents the change in the actual pressure $P_r$ in an intake manifold as a function of time over several engine cycles. It is the change in pressure in a 90° V two-cylinder engine measured on a test bench. Furthermore, the labels $A_n$ correspond to the different intake phases.

It will be understood that the larger the volume of the intake manifold 2, the less the negative pressure observed during an intake phase $A_n$ will be, since the volume passing through the intake manifold 2 toward the combustion cylinder 3 will be small compared with the total volume of the manifold. By contrast, for engines having intake manifolds 2 with small volumes (typically V two-cylinder engines and in particular 90° V two-cylinder engines), the negative pressure observed in the intake manifold 2 will be significant during an intake phase $A_n$.

Furthermore, when none of the cylinders of the engine 1 is in an intake phase, that is to say when the engine 1 is between two intake phases $A_n$-$A_{n+1}$, the pressure in the intake manifold 2 rises gradually until it reaches a maximum value substantially equal to atmospheric pressure if the time interval between the two intakes $A_n$-$A_{n+1}$ is sufficient. Specifically, since a negative pressure in the intake manifold 2 is caused by the passage of the air from the intake manifold 2 toward a combustion cylinder 3 and therefore by the reduction in the quantity of air in the intake manifold 2, it will be understood that, when the air is no longer passing from the intake manifold 2 to the combustion cylinder 3 and air is entering the intake manifold 2 via the entering air flow regulated by the throttle 9, the quantity of air in the intake manifold increases gradually again. As a result, the pressure in the intake manifold 2 rises gradually until it reaches a maximum pressure value corresponding to the pressure of the entering air flow, that is to say to atmospheric pressure if the time interval between the two consecutive intakes $A_n$-$A_{n+1}$ is sufficient. When the time between two consecutive intakes $A_n$-$A_{n+1}$ is not sufficient, the pressure before the intake $A_{n+1}$ rises to an intermediate value between the value that it had following the negative pressure brought about by the intake $A_n$ and the maximum value corresponding to atmospheric pressure.

An embodiment of the method for estimating the pressure in an intake manifold 2 will now be described with reference to FIG. 1.

The method for estimating the pressure in the intake manifold 2 thus comprises a first step of measuring 110, with the pressure sensor 4, a maximum pressure value $P_{max}$ corresponding substantially to a maximum pressure in the intake manifold 2 during a cycle of the combustion engine.

Those skilled in the art are familiar with pressure sensors for detecting the relative pressure minimums and maximums. In this case, the pressure sensor 4 is advantageously a pressure sensor of this type and the pressure measurement is carried out at a pressure maximum over the engine cycle corresponding to an absolute pressure maximum over the engine cycle.

In the case of a pressure sensor 4 that is not capable of detecting relative pressure extremes, the measurement of the pressure value $P_{max}$ is advantageously carried out at a time directly preceding an intake phase $A_n$ of a combustion cylinder 3.

Specifically, as explained above, during an intake phase of a combustion cylinder 3, that is to say when the intake valve 7 of the combustion cylinder 3 is open and the piston 5 descends in the combustion cylinder 3, air coming from the intake manifold 2 is introduced into the combustion cylinder 3 and, as a result, a negative pressure is observed in the intake manifold 2. In other words, the transfer of the air from the intake manifold 2 to the combustion cylinder 3 brings about a negative pressure in the intake manifold 2. In this regard, the time directly preceding the intake phase $A_n$ of a combustion cylinder 3 corresponds to a pressure maximum in the intake manifold 2.

This will be an absolute or relative pressure maximum depending on the model of the engine. Specifically, when the engine 1 comprises an intake manifold 2 in fluidic communication with only one combustion cylinder 3, this is the absolute pressure maximum since the negative pressure in the intake manifold 2 will only occur once per engine cycle.

On the other hand, when the engine 1 comprises an intake manifold 2 in fluidic communication with a plurality of combustion cylinders 3, there are as many intake phases $A_n$ as there are combustion cylinders 3 during an engine cycle. In that respect, as many negative pressures are observed in the intake manifold 2 as there are combustion cylinders 3. In engines having configurations referred to as "in-line" or "flat", this has only little impact on the measurement of the maximum pressure value $P_{max}$ which could be measured before the intake phase $A_n$ of each combustion cylinder 3 of the engine cycle since each of these measurements will provide substantially the same result. By contrast, in other engine configurations referred to as "phase-offset" engines in the rest of the document, the value of a pressure measurement $P_{max}$ before an intake phase $A_n$ of a given combustion cylinder 3 will be significantly different than the value of a pressure measurement $P_{max}$ before another intake phase $A_n$+k of another combustion cylinder 3 during the same engine cycle. The phenomenon is well illustrated in FIG. 3, which clearly shows that the value of the actual pressure maximums $P_r$ in the intake manifold 2 is not the same before the different intake phases $A_n$. FIG. 3 shows, over several consecutive engine cycles, a maximum pressure value $P_{maxC1}$ corresponding to a maximum pressure in the intake manifold 2 preceding an intake phase $A_n$ into a first combustion cylinder 3 and another maximum pressure value $P_{maxC2}$ corresponding to a maximum pressure in the manifold preceding an intake phase $A_{n+1}$ into a second combustion cylinder 3.

In particular, the maximum pressure value $P_{maxC1}$ preceding the intake phase into the first cylinder $A_n$ is greater than the maximum pressure value $P_{maxC2}$ preceding the intake phase into the second cylinder $A_{n+1}$. Specifically, in the 90° V two-cylinder engine, the geometry of the engine means that there is a different between a duration $t_{12}$ between two consecutive intake phases $A_1$. (intake into a first combustion cylinder) and $A_2$ (intake into a second combustion cylinder) and a duration $t_{23}$ between the following consecutive intake phases $A_2$ (intake into the second combustion cylinder) and $A_3$ (intake into the first combustion cylinder of the following engine cycle). This difference is due to a different angular movement of the crankshaft 8 between the phases $A_1$-$A_2$ and $A_2$-$A_3$. The "phase-offset" engines are therefore defined as being engines in which the intake manifold 2 is in fluidic communication with a plurality of combustion cylinders 3 and in which the angular movement of the crankshaft 8 is different between two same phases of the engine cycle that are executed in two consecutive different combustion cylinders. In other words, once the angular movement of the crankshaft is not the same between $A_{n-1}$ and $A_n$ and between $A_n$ and $A_{n+1}$, the engine is an engine referred to as "phase-offset".

For example, in the case of the 90° V two-cylinder engine of which the curve of the actual pressure $P_r$ in the intake manifold is shown in FIG. 3, if the intake phase $A_1$ is considered to be carried out in the first cylinder 3 when the crankshaft 8 is positioned at 0°CRK, the intake phase $A_2$ in the second cylinder 3 will be carried out when the crankshaft 8 is positioned at 270°CRK (360-90 on account of the geometry of the engine). The unit °CRK represents an angular position of the crankshaft 8 which varies between 0 and 720°CRK in each engine cycle for a 4-stroke engine. The crankshaft 8 has therefore passed through 270°CRK between an intake $A_1$ into the first combustion cylinder 3 and an intake $A_2$ into the second combustion cylinder 3 of the engine.

If consideration is now given to the movement of the crankshaft 8 between the intake $A_2$ into the second cylinder 3 of the current engine cycle at 270°CRK and the intake $A_3$ into the first cylinder 3 of the following engine cycle, it is known that this intake $A_3$ is carried out at 720°CRK of the current cycle (equivalent to 0°CRK of the following engine cycle) since this is the start of the new engine cycle. The crankshaft 8 has therefore passed through 450°CRK (720-270) between the intake $A_2$ into the second cylinder 3 and the intake $A_3$ into the first cylinder 3. The angular movements of the crankshaft 8 are therefore not equal between the two intakes $A_1$ and $A_2$ (270°CRK) and the two intakes $A_2$ and $A_3$ (450°CRK) of the 90° V two-cylinder engine. There is therefore an "angular offset" of the crankshaft 8 between two same phases of the engine in different combustion cylinders 3, the angular offset denoting the fact that, between two same phases of the engine cycle that are carried out in a different combustion cylinder 3, the crankshaft 8 does not carry out the same angular movement. The phenomenon of angular offset is observed in all engines in which the combustion cylinders 3 are not disposed in the configuration referred to as "in-line" or "flat", that is to say for the "phase-offset" engines that were introduced above.

In this regard, it will be understood that the time interval $t_{12}$ between the intake $A_1$ and the intake $A_2$ and the time interval $t_{23}$ between the intake $A_2$ and the intake $A_3$ do not correspond to the same value since the angular movement of the crankshaft 8 is not the same. The time interval $t_{12}$ is therefore shorter than the time interval $t_{23}$, as illustrated in FIG. 3. However, it was explained above that the pressure in the intake manifold 2 rises between two consecutive intake phase and therefore rises during the durations $t_{12}$ and $t_{23}$. In the example in FIG. 3, the duration $t_{23}$ is longer than the duration $t_{12}$. The pressure in the intake manifold 2 therefore rises more during the duration $t_{23}$ and it is for this reason that the pressure value $P_{maxC1}$ is higher than the pressure value $P_{maxC2}$.

It will thus be understood that the use of an average value as the value for estimating the pressure in the intake manifold is not at all relevant for correcting an injection time of an injector 10 when the engine is a "phase-offset" engine. Specifically, FIG. 3 clearly shows that the pressure value in the intake manifold 2 at the time of the injection into a first combustion cylinder 3 is completely different than the pressure value in the manifold at the injection into a second combustion cylinder 3. Choosing the average pressure value in the intake manifold of the engine cycle in order to correct an injection time of an injector 10 into a combustion cylinder 3 therefore does make it possible to adapt to situations as described above for the 90° V two-cylinder engine and more generally for all "phase-offset" engines.

The case of a 90° V two-cylinder engine was presented above, but it will also be understood that an average value in a single-cylinder or two-cylinder engine not comprising an "angular offset" is also not very precise once the pressure in the intake manifold 2 fluctuates greatly with regard to its small volume. In particular, for a given injection time, it may be the case that the average pressure in the intake manifold 2 does not correspond at all to the actual pressure at that time. In that case, the error in the estimation of the pressure in the intake manifold 2 has an impact on the estimated instantaneous flow rate of the injector 10 and then on the injection time of the injector and ultimately on the quantity of fuel injected into the intake manifold 2. An imprecise quantity of fuel injected may in particular result in an increase in the emission of pollutants and in poor combustion in the cylinder.

Returning to the measurement of the value $P_{max}$, in an embodiment in which the engine 1 is a "phase-offset" motor, the measurement of the pressure value $P_{max}$ is advantageously carried out at a time directly preceding an intake phase $A_n$ of a combustion cylinder 3 corresponding to the intake $A_n$ directly following the greatest movement of the crankshaft between two consecutive intake phases $A_n$-$A_{n+1}$ in the engine cycle. This makes it possible to obtain the absolute maximum pressure in the engine cycle. In our example in FIG. 3, the pressure value $P_{max}$ is thus equal to the pressure value $P_{maxC1}$ in each engine cycle.

This first step therefore makes it possible to obtain the maximum pressure value $P_{max}$ in a current engine cycle, and this value will be used subsequently to evaluate the pressure in the intake manifold 2 of the following engine cycle.

The method then comprises a second step of measuring 120, with the pressure sensor 4, a minimum pressure value $P_{min}$ corresponding substantially to a minimum pressure in the intake manifold 2 during a cycle of the engine.

In the case of a pressure sensor 4 that is not capable of detecting relative pressure extremes, the measurement 120 of the minimum pressure value $P_{min}$ is advantageously carried out at a time directly preceding a compression phase of the combustion cylinder 3. Since the compression phase is the phase following the intake phase, the minimum pressure value $P_{min}$ in the intake manifold 2 is therefore measured at the very end of the intake phase of the combustion cylinder 3. Specifically, throughout the intake phase, air passes from the intake manifold 2 to the combustion cylinder 3 and hence the negative pressure observed in the intake manifold 2 is at its maximum at the end of the intake phase since a maximum quantity of air has passed through the intake manifold 2 toward the combustion cylinder 3.

In the case in which the intake manifold 2 is in fluidic communication with a plurality of combustion cylinders 3, this step may be implemented as many times as there are combustion cylinders 3 so as to have a plurality of pressure values $P_{min}$ during the engine cycle. Specifically, just as for the pressure maximums in the intake manifold 2 in an engine cycle, the pressure minimums may be significantly different during the engine cycle for the "phase-offset" engines. For example, in the case of the 90° V two-cylinder engine shown in FIG. 3, a first minimum pressure value $P_{minC1}$ corresponding to a pressure minimum of the engine cycle following the air intake phase $A_1$ into the first combustion cylinder 3 of the engine is illustrated. A second minimum pressure value $P_{minC2}$ corresponding to another pressure minimum following the air intake phase $A_2$ into the second combustion cylinder 3 of the engine is also illustrated. The pressure value $P_{minC2}$ is significantly lower than the pressure value $P_{minC1}$ since, on account of the geometry of the 90° V two-cylinder engine, the pressure in the intake manifold 2 after the intake $A_1$ has not risen to the value that it had before said intake $A_1$. As a result, during the intake $A_2$, the pressure drops to a level lower than the minimum pressure value $P_{minC1}$ again.

In the embodiment comprising a plurality of combustion cylinders 3, an optional additional step of calculating 125 an average minimum pressure value $P_{amin}$ may be implemented by the computer for example by calculating an average or all or some of the pressure values $P_{min}$ measured by the pressure sensor 4 during the cycle of the engine. Thus, in the context of the 90° V two-cylinder engine, an average minimum pressure value Pamirs could be equal to the sum of the minimum pressures $P_{minC1}$ and $P_{minC2}$ divided by two. This calculating step 125 is only implemented when a similar step has previously been implemented during the calculation of the correction factors $F_c$, which we shall return to later.

It was stated in the introduction that a pressure in the intake manifold 2 is dependent on an angular position of the crankshaft 8, on an engine speed N of the engine 1 and on an engine load. In this case, the values $P_{min}$ (or $P_{amin}$) and $P_{max}$ of an engine cycle are used in the rest of the method to determine the pressure in the intake manifold 2 of the following engine cycle. Specifically, these are relevant values inasmuch as the engine speed N and the engine load are substantially the same between two consecutive engine cycles. In this way, the method makes it possible to estimate the pressure in the intake manifold 2 of a current engine cycle by simply acquiring one or more minimum pressure values $P_{min}$ and a maximum pressure value $P_{max}$ of the preceding engine cycle without requiring other acquisitions.

In particular, the method for estimating the pressure in the intake manifold makes it possible to find the actual pressure $P_r$ of the intake manifold 2 that is obtained on a test bench (as illustrated in FIG. 3 for a 90° V two-cylinder engine) from pressure values $P_{min}$ (or $P_{amin}$ if appropriate) and $P_{max}$, which were measured during the execution of the method. This actual pressure $P_r$ of the manifold that is measured on a test bench will be considered to be the current pressure in the intake manifold 2 during the execution of the method. It is therefore a matter, in the following steps, of linking the values $P_{min}$ (or $P_{amin}$) and $P_{max}$, which were acquired during the execution of the method (and therefore during the current operation of the engine), with the curve of the actual pressure $P_r$ measured on a test bench.

In this regard, the method comprises a third step of determining 130 an average pressure correction factor $F_{ac}$ on the basis of a determined crankshaft angular position V°CRK and of an engine speed N. The crankshaft angular position V°CRK varies between 0 and 720°CRK in each cycle of the engine (four-stroke engine). The engine speed N is the number of revolutions effected by the engine in a certain time, is generally expressed in revolutions per minute (rpm) and it is this unit that will be used in the equations which will be described in detail below.

The average correction factor $F_{ac}$ makes it possible to estimate a pressure $P_{col}$ in the intake manifold 2 in a current engine cycle on the basis of one or more minimum pressures $P_{min}$ and of a maximum pressure $P_{max}$ that were acquired during the preceding engine cycle. The pressure $P_{col}$ denotes the estimated pressure in the intake manifold 2 when the method is implemented, while the pressure $P_r$ denotes the pressure observed in the intake manifold 2 on a test bench.

The average correction factor $F_{ac}$ is calculated on a test bench before the method is implemented and is dependent both on the engine speed N and on the crankshaft angle V°CRK. It is thus associated with a determined engine speed N and with a determined crankshaft angular position V°CRK. It may be stored in the memory of the computer suitable for controlling the implementation of the method or in any other memories to which this computer has access. In fact, the memory comprises a set of average correction factors $F_{ac}$ that may for example be contained in a table of average correction factors $T_{Fac}$, where each average correction factor $F_{ac}$ is associated with a crankshaft angular position V°CRK and with an engine speed N so as to have an average correction factor $F_{ac}$ corresponding to the current operation of the engine (and in particular to the current engine speed N) during the execution of the method. The table of average correction factors $T_{Fac}$ is preferably stored directly in the memory of the computer controlling the implementation of the method.

Advantageously, the determination 130 of the average correction factor $F_{ac}$ corresponds to the selection, from the table of average correction factors $T_{Fac}$, of the average correction factor $F_{ac}$ associated with the engine speed N that comes closest to the current engine speed N during the use of the method and associated with the crankshaft angular position V°CRK that comes closest to the determined crankshaft angular position V°CRK.

Before developing the rest of the method for estimating the pressure in the intake manifold, an embodiment for calculating an average correction factor $F_{ac}$ associated with a crankshaft angular position V°CRK for a determined engine speed N is presented below. To construct the table of average correction factors $T_{Fac}$, it will simply be a matter of varying the crankshaft angular position V°CRK and/or the determined engine speed N.

Thus, for a determined engine speed N and for a determined crankshaft angular position V°CRK, a correction factor $F_c$ is calculated intermediately before it is possible to obtain the average correction factor $F_{ac}$. This correction factor $F_c$ is also dependent on an engine load parameter, which means that, for a determined crankshaft angular position V°CRK and for a determined engine speed N, there are a plurality of correction factors $F_c$, each correction factor $F_c$ also being associated with an engine load value.

Thus, the correction factor $F_c$ is calculated on the basis of the following formula:

$$F_c = \frac{(P_r - P_{maxt})}{(P_{mint} - P_{maxt})} \quad \text{[Math. 3]}$$

where $F_c$ corresponds to the correction factor, $P_r$ corresponds to an actual pressure value measured on a test bench in an intake manifold for the determined crankshaft angular position V°CRK for a current engine cycle, $P_{maxt}$ corresponds to a maximum pressure value of the intake manifold on a test bench of the preceding engine cycle, and $P_{mint}$ corresponds to a minimum pressure value of the intake manifold on a test bench of the preceding engine cycle.

The pressure values ($P_r$, $P_{maxt}$, $P_{mint}$) are measured for a combustion engine of the same type (of the same kind) as that on which the method will be subsequently implemented, that is to say one in which the intake manifold 2 has a substantially identical volume, is in fluidic communication with the same number of combustion cylinders 3 and in which, if appropriate, the same "angular offset" of the crankshaft exists.

Advantageously, the pressure value $P_{maxt}$ and the pressure value or values $P_{mint}$ are measured substantially at the same crankshaft angular positions V°CRK as those for which they will be measured during the implementation of the method.

Furthermore, when the additional calculating step 125 is implemented during the method, that is to say when there are a plurality of pressure values $P_{min}$ measured during the preceding engine cycle, the value $P_{mint}$ of the calculation of the correction factor $F_c$ is replaced by a minimum average value $P_{amint}$ corresponding to an average value of all or some of the values $P_{mint}$ determined in the preceding cycle on a test bench. Of course, the minimum average value $P_{amin}$ determined during the execution of the method and the minimum average value $P_{amint}$ determined on a test bench are calculated in the same way. This means that if the minimum average value $P_{amint}$ for calculating the correction factor $F_c$ is calculated on the basis of the minimum values $P_{mint}$ of the set of combustion cylinders, the step 125 of the method will correspond to the same calculation for the minimum values $P_{min}$ measured for the set of combustion cylinders 3.

In this case, the correction factor $F_c$ is therefore calculated on the basis of the following formula:

$$F_c = \frac{(P_r - P_{maxt})}{(P_{amint} - P_{maxt})} \quad \text{[Math. 4]}$$

where $F_c$ corresponds to the correction factor, $P_r$ corresponds to an actual pressure value measured on a test bench in an intake manifold for the determined crankshaft angular position V°CRK for a current engine cycle, $P_{maxt}$ corresponds to a maximum pressure value of the intake manifold on a test bench of the preceding engine cycle, and $P_{amint}$ corresponds to an average minimum pressure value obtained from all or some of the minimum pressure values $P_{mint}$ measured on a test bench of the preceding engine cycle.

The correction factor $F_c$ therefore corresponds to a factor linking the actual pressure $P_r$ observed in the intake manifold on a test bench and the minimum pressure value $P_{mint}$ (or $P_{amint}$ if appropriate) and the maximum pressure value $P_{maxt}$ that were measured in the intake manifold 2 on a test bench for a determined engine speed N and for a determined engine load.

In order to obtain the average correction factor $F_{ac}$, it is then a matter of taking the average of the correction factors $F_c$ associated with the determined crankshaft angular position V°CRK for the determined engine speed N for the different engine load values. The average correction factor $F_{ac}$, associated with the determined crankshaft angular position V°CRK for the determined engine speed N, therefore dispenses with the engine load parameter compared with the correction factor $F_c$.

Figure 4:
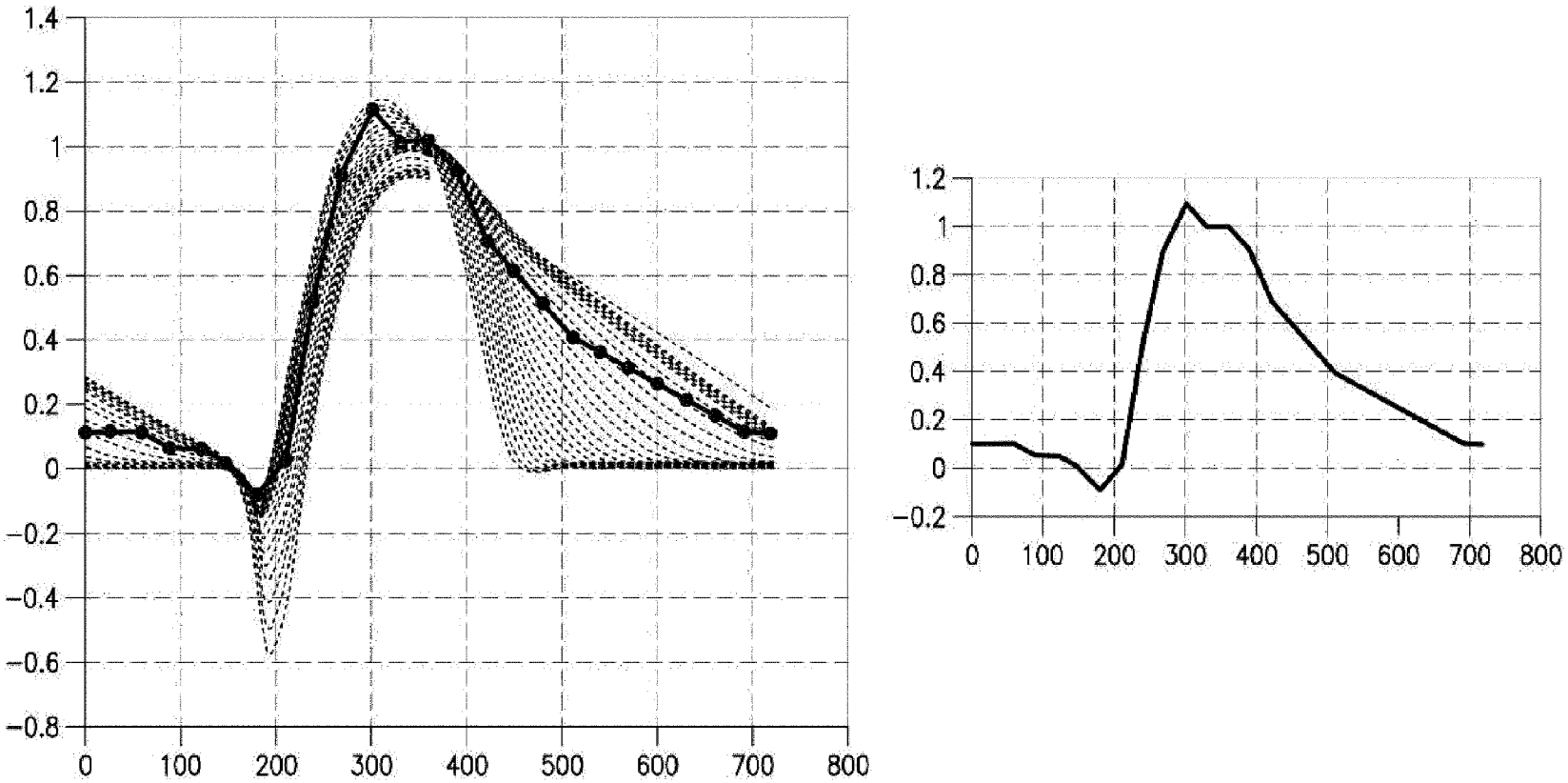
FIG. 4 shows two diagrams, each showing, on the X-axis, a crankshaft angular position during an engine cycle and, on the Y-axis, a correction factor value.

An example of a plurality of correction factors $F_c$ for a determined engine speed N is shown in the left-hand graph in FIG. 4. The X-axis of the graph corresponds to the different crankshaft angular positions V°CRK during an engine cycle, while the Y-axis corresponds to the value of the correction value $F_c$. Each curve in the left-hand graph thus comprises a plurality of correction factors $F_c$ representing the correction factor values $F_c$ calculated for an engine load value determined at each crankshaft angular position V°CRK in an engine cycle.

On the basis of these correction factor values $F_c$, it is therefore possible to determine a curve of average correction factors $F_{ac}$ as a function of a crankshaft angular position V°CRK for the determined engine speed N via the use of the average value. This is the object of the right-hand graph in FIG. 4. The average correction factor value $F_{ac}$ is plotted on the Y-axis and the different crankshaft angular positions V°CRK are plotted on the X-axis. The curve of average correction values $F_{ac}$ thus corresponds to the average of the correction factors $F_c$ calculated for the determined engine speed N over the entire crankshaft angular range V°CRK. In other words, the curve in the right-hand graph corresponds to the average of the curves of correction factors $F_c$ associated with a respective engine load and shown in the right-hand graph. Put in yet another way, for a given angular position V°CRK, the average correction factor $F_{ac}$ is equal to the average of the correction factors $F_c$ associated with this angular position V°CRK for the different engine load values.

The average correction factor $F_{ac}$ therefore corresponds to the factor linking the actual pressure $P_r$ observed in the intake manifold in a current engine cycle with one or more minimum pressure values $P_{mint}$ (or $P_{amint}$) and a maximum pressure value $P_{maxt}$ that were measured in the intake manifold 2 on a test bench in the preceding engine cycle for a determined engine speed N. It dispenses with the engine load parameter compared with the correction factor $F_c$.

Furthermore, beyond the fact that the average correction factor $F_{ac}$ makes it possible to dispense with the engine load parameter, it will be understood that the table of average correction factors $T_{Fac}$ requires a memory size much smaller than that of a table containing all of the correction factors $F_c$. In particular, the factor existing between the sizes of the two memories corresponds to the number of engine load values taken into account in the calculation of the correction factors $F_c$.

Returning to the execution of the method presented with reference to FIG. 1, an average correction factor $F_{ac}$ has thus been determined for a determined engine speed N and for a determined crankshaft angular position V°CRK.

The method thus comprises a fourth step 140 of estimating the pressure $P_{col}$ in the intake manifold 2 for the determined crankshaft angular position V°CRK (corresponding to that of the average correction factor $F_{ac}$).

The pressure $P_{col}$ of the current engine cycle is estimated from the average correction factor $F_{ac}$ and from one or more minimum pressure values $P_{min}$ ($P_{amin}$ if appropriate) and from a maximum pressure value $P_{max}$, which were measured during the preceding engine cycle during the measuring steps 110 and 120.

Specifically, once the average correction factor $F_{ac}$ has been determined, the latter forming the link between the pressure values $P_{mint}$ (or $P_{amint}$) and $P_{maxt}$ that were measured on a test bench and the actual pressure value $P_r$ in the intake manifold 2 that was measured on a test bench, it is possible to estimate the pressure $P_{col}$ in the intake manifold 2 for the angular position V°CRK of the current engine cycle corresponding to that of the average correction factor $F_{ac}$ determined at the end of step 130. It is therefore a matter of linking an average correction factor $F_{ac}$ pre-calculated from values $P_{mint}$ and $P_{maxt}$ measured on a test bench and from the actual pressure $P_r$ measured on a test bench with pressure values $P_{min}$ and $P_{max}$ measured during the execution of the method in order to find the pressure $P_{col}$ of the intake manifold 2.

In particular, the pressure $P_{col}$ in the intake manifold can be estimated on the basis of the following formula:

$$P_{col}=P_{max}=(P_{min}-P_{max})\times F_{ac} \quad \text{[Math. 5]}$$

where $P_{col}$ corresponds to the pressure in the intake manifold for the determined crankshaft angular position V°CRK of the current engine cycle, $P_{max}$ corresponds to the maximum pressure value of the preceding engine cycle that was measured during step 110 of the method, $P_{min}$ corresponds to the minimum pressure value in the intake manifold of the preceding engine cycle that was measured during step 120 of the method, and $F_{ac}$ corresponds to the average correction factor pre-calculated on a test bench for the determined crankshaft angular position V°CRK.

In the embodiment in which step 125 of calculating an average minimum pressure value $P_{amin}$ is implemented, the pressure $P_{col}$ is estimated on the basis of the following formula:

$$P_{col}=P_{max}=(P_{amin}-P_{max})\times F_{ac} \quad \text{[Math. 6]}$$

where $P_{col}$ corresponds to the pressure in the intake manifold for the determined crankshaft angular position V°CRK of the current engine cycle, $P_{max}$ corresponds to the maximum pressure value of the preceding engine cycle that was measured during step 110 of the method, $P_{amin}$ corresponds to the average minimum pressure value calculated during step 125 of the method, and $F_{ac}$ corresponds to the average correction factor pre-calculated on a test bench for the determined crankshaft angular position V°CRK.

As a result of the method being implemented, it is possible to determine the pressure $P_{col}$ in the intake manifold 2 of the engine for each angular position of the crankshaft 8. In other words, it is therefore possible to determine the pressure downstream of the tip of the injector 10 for each angular position of the crankshaft 8. It is thus possible to find the instantaneous flow rate of the injector 10 at a given time as long as the angular position of the crankshaft 8 at this time is known. In particular, it is possible to determine an angular position of the crankshaft 8 at a time $t_{mi}$ at the middle of injection of the injector by using the following formula:

$$\left[V_{mi} = V_{ei} - T_i \times \left(\frac{3N}{1000}\right)\right] \text{modulo } 720°$$

where $V_{mi}$ corresponds to the crankshaft angular position at the middle of injection of the injector 10 in °CRK, $V_{ei}$ corresponds to the crankshaft angular position at the end of injection of the injector 10 in °CRK, $T_i$ corresponds to the injection time of the injector 10 in ms, and N corresponds to the number of revolutions per minute of the engine.

This equation is of course modulo 720°CRK inasmuch as the crankshaft 8 carries out two revolutions during an engine cycle (four-stroke engine).

The angular position of the crankshaft at the end of injection in a combustion cylinder is a known value. In the same way, the injection time $T_i$ is known and the term (3N/1000) makes it possible to convert it into a crankshaft angle corresponding to half the movement of the crankshaft during the injection time $T_i$. Therefore, an angle corresponding to half the movement of the crankshaft 8 during the injection is subtracted from the angular position $V_{ei}$°CRK of the crankshaft at the end of injection in order to find the angular position $V_{mi}$°CRK of the crankshaft 8 at the middle of injection of the injector 10 at the time $t_{mi}$.

It is thus possible to determine an instantaneous flow rate of the injector 10 of a current engine cycle by using the pressure $P_{col}$ estimated at the time $t_{mi}$ at the middle of injection of a preceding engine cycle through the use of methods known to those skilled in the art.

A method for correcting a quantity of fuel injected by an injector 10 into an intake manifold 2 will now be described with reference to FIG. 5.

The method comprises a first step of estimating 210 a pressure $P_{col}$ at the middle of injection in the intake manifold 2 by implementing a method for estimating the pressure in the intake manifold as described above for a crankshaft angular position $V_{mi}$ at the middle of injection of the injector 10.

The method comprises a second step of determining 220 an instantaneous flow rate of the injector 10 at a time $t_{mi}$ at the middle of injection from the pressure $P_{col}$ in the intake manifold 2 and from the pressure of the fuel in the injector 10.

Inasmuch as the instantaneous flow rate is calculated from the pressure values in the intake manifold 2, the pressure values $P_{col}$ obtained by the method being more precise than those obtained by the methods set out in the prior art (in particular the methods based on the average value), the instantaneous flow rate obtained at the end of this step is therefore itself more precise.

Lastly, the method comprises a final step of modifying 230 an injection time of the injection 10 depending on its instantaneous flow rate at the time $t_{mi}$ at the middle of injection in order to correct a quantity of fuel injected by the injector 10.

The method for estimating the pressure in the intake manifold according to an aspect of the invention therefore makes it possible to estimate a pressure in the intake manifold precisely for each position of the crankshaft at a determined engine speed with very few acquisitions of pressure in the manifold. In particular, all that is necessary is a minimum pressure measurement and a maximum pressure measurement in order to make this estimate, this making it possible, inter alia, to address the real-time priorities of the system, to lengthen the service life of the pressure sensor and to reduce the storage memory associated with the sensor.

In this case, the fact that the method according to an aspect of the invention makes it possible to estimate the pressure in the intake manifold for each angular position of the crankshaft makes it possible to obtain a precise estimate of the pressure even when the pressure variations in the engine are large during a single engine cycle.

In the same way, the possibility of estimating the pressure in the intake manifold for each angular position of the crankshaft makes it possible to use the method for different engine geometries and in particular for "phase-offset" engines such as 90° V two-cylinder engines without losing estimation precision.

This lastly makes it possible to estimate the pressure in the intake manifold at the time of fuel injection rather than using as a basis an average pressure value which is potentially very far away from the actual pressure in the intake manifold at this precise time. In this way, the method for estimating the pressure in the manifold may also be used to correct a quantity of fuel injected. Specifically, as explained above, obtaining a precise estimate of the pressure in the intake manifold at the injection time makes it possible to obtain a precise instantaneous flow rate of the injector at this time and therefore makes it possible to correct a quantity of fuel by modifying an injection time of the injector depending on its instantaneous flow rate.

The invention claimed is:

1. A method for estimating a pressure in an intake manifold of an indirect injection combustion engine, comprising a pressure sensor measuring the pressure in the intake manifold, the intake manifold being in fluidic communication with a combustion cylinder, a piston being guided in translation in the combustion cylinder and connected to a rotating crankshaft, said method comprising:

measuring, with the pressure sensor, a maximum pressure value corresponding substantially to a maximum pressure in the intake manifold during a preceding cycle of the engine;

measuring, with the pressure sensor, a minimum pressure value corresponding substantially to a minimum pressure in the intake manifold during the preceding cycle of the engine;

determining a pre-calculated average pressure correction factor from a crankshaft angular position and from an engine speed; and estimating the pressure in the intake manifold for the crankshaft angular position of the current engine cycle from the average correction factor and from the minimum and maximum pressure values.

2. The method as claimed claim 1, wherein the measurement of the maximum pressure value is carried out at a time directly preceding an intake phase of the combustion cylinder, and the measurement of the minimum pressure value carried out at a time directly preceding a compression phase of the combustion cylinder.

3. The method as claimed in claim 1, wherein the average correction factor is determined from a table of correction factors comprising a plurality of average correction factors that are each associated with an engine speed and a determined angular position, and the determination of the average correction factor comprises the selection, from this table, of the average correction factor that is associated with the engine speed and with the corresponding angular position or that comes closest to the current engine speed and the determined crankshaft angular position.

4. The method as claimed in claim 1, wherein an average correction factor for a determined engine speed and for a determined angular position is equal to the average of the correction factors having the same determined engine speed and the same determined angular position, and a correction factor is obtained from the following formula:

$$F_c = \frac{(P_r - P_{maxt})}{(P_{mint} - P_{maxt})} \quad \text{[Math. 8]}$$

where $F_c$ corresponds to the correction factor, $P_r$ corresponds to the actual pressure measured on a test bench in an intake manifold for the determined angular position for a current engine cycle, $P_{maxt}$ corresponds to a maximum pressure value of the intake manifold on a test bench of the preceding engine cycle, and $P_{mint}$ corresponds to a minimum pressure value of the intake manifold on a test bench of the preceding engine cycle.

5. The method as claimed in claim 1, wherein the estimation of the pressure in the intake manifold comprises the use of the following formula:

$$P_{col}=P_{max}\times(P_{min}-P_{max})\times F_{ac} \quad \text{[Math. 9]}$$

where $P_{col}$ corresponds to the pressure in the intake manifold of the current cycle of the engine for the crankshaft angular position, $P_{max}$ corresponds to the maximum pressure value of the engine cycle preceding the current cycle and measured during the measuring step, $P_{min}$ corresponds to the minimum pressure value in the intake manifold of the engine cycle preceding the current cycle and measured during the measuring step, and $F_{ac}$ corresponds to the average correction factor for the crankshaft angular position determined during the determining step.

6. The method as claimed in claim 1, wherein the intake manifold is in fluidic communication with a plurality of combustion cylinders, the step of measuring a pressure value is implemented for each combustion cylinder, the method comprises an additional step of calculating an average minimum pressure value, and the average minimum pressure value is used instead of the minimum pressure in the estimation of the pressure in the intake manifold.

7. A method for correcting a quantity of fuel injected in an indirect injection engine comprising a pressure sensor measuring the pressure in an intake manifold, the intake manifold being in fluidic communication with a combustion cylinder, a piston being guided in translation in the combustion cylinder and connected to a rotating crankshaft, the engine also comprising an injector, the tip of which is disposed in the intake manifold, the method comprising:

estimating a pressure at the middle of injection in the intake manifold by implementing a method for estimating the pressure as claimed in any one of the preceding claims for a crankshaft angular position at the middle of injection of the injector;

determining an instantaneous flow rate of the injector at a time at the middle of injection from the pressure in the intake manifold and from the pressure of the fuel in the injector; and modifying an injection time of the injector depending on its instantaneous flow rate at the time at the middle of injection.

8. A computer program product comprising code instructions stored on a computer-readable medium for implementing the steps of a method as claimed in claim 1 when said program is run on a computer.

9. A computer suitable for controlling an indirect injection engine comprising a pressure sensor measuring the pressure in an intake manifold, the intake manifold being in fluidic communication with a combustion cylinder, a piston being guided in translation in the combustion cylinder and connected to a rotating crankshaft, the engine also comprising an injector, the tip of which is disposed in the intake manifold, wherein the computer is also suitable for controlling the implementation of a method as claimed in claim 1.

10. An indirect injection engine comprising a pressure sensor measuring the pressure in an intake manifold, the intake manifold being in fluidic communication with a combustion cylinder via one or more intake valves, a piston being guided in translation in the combustion cylinder and connected to a rotating crankshaft, the engine also comprising an injector, the tip of which is disposed in the intake manifold, wherein the engine also comprises a computer as claimed in claim 9.

* * * * *